US008677723B2

(12) United States Patent
Böttger et al.

(10) Patent No.: US 8,677,723 B2
(45) Date of Patent: Mar. 25, 2014

(54) METHOD FOR FILLING DUAL-CHAMBER SYSTEMS IN PRE-STERILIZABLE CARRIER SYSTEMS AND PRE-STERILIZABLE CARRIER SYSTEM

(75) Inventors: Frank Böttger, Ravensburg (DE); Benjamin Böbst, Mittelbiberach (DE)

(73) Assignee: Arzneimittel GmbH Apotheker Vetter & Co. Ravensburg, Ravensburg (DE)

( * ) Notice: Subject to any disclaimer, the term of this patent is extended or adjusted under 35 U.S.C. 154(b) by 682 days.

(21) Appl. No.: 12/997,218

(22) PCT Filed: Jun. 16, 2009

(86) PCT No.: PCT/EP2009/004308

§ 371 (c)(1),
(2), (4) Date: Dec. 9, 2010

(87) PCT Pub. No.: WO2009/153014

PCT Pub. Date: Dec. 23, 2009

(65) Prior Publication Data

US 2011/0094188 A1 Apr. 28, 2011

(30) Foreign Application Priority Data

Jun. 19, 2008 (DE) ..... 10 2008 030 267

(51) Int. Cl.
*B65B 55/02* (2006.01)
*B65B 7/00* (2006.01)

(52) U.S. Cl.
USPC ..... 53/426; 53/425; 53/428; 53/468; 53/471; 53/489

(58) Field of Classification Search
USPC ..... 53/425, 426, 428, 468, 471, 489
See application file for complete search history.

(56) References Cited

U.S. PATENT DOCUMENTS 5,080,649 A 1/1992 Vetter
5,439,703 A 8/1995 Kanda et al.

(Continued)

FOREIGN PATENT DOCUMENTS

DE 10028823 A1 12/1998
DE 10341978 A1 9/2004

(Continued)

OTHER PUBLICATIONS

English translation of First Office Action for corresponding Japanese Patent Application No. 2011-513939, issued Jan. 28, 2013 (3 pages).

(Continued)

*Primary Examiner* — Hemant M Desai
*Assistant Examiner* — Gloria R Weeks
(74) *Attorney, Agent, or Firm* — Harness, Dickey & Pierce, P.L.C.

(57) ABSTRACT

A method for filling dual-chamber systems in pre-sterilizable carrier systems includes providing at least one washed, siliconized and sterilized dual-chamber system in a magazine. The dual-chamber system includes respective separating elements separating the two chambers from each other. The magazine accommodates at least one dual-chamber system and is arranged in a container that is sealed with a closing element. The method additionally includes introducing the container into a clean room; opening the container and filling a first chamber of the at least one dual-chamber system; and closing the first chamber. The method further includes filling a second chamber of the at least one dual-chamber system; closing the second chamber; and removing the system from the clean room.

17 Claims, 5 Drawing Sheets

(56) References Cited

U.S. PATENT DOCUMENTS

| | | | | |
|---|---|---|---|---|
| 5,788,670 | A * | 8/1998 | Reinhard et al. | 604/89 |
| 6,189,292 | B1 | 2/2001 | Odell et al. | |
| 6,224,568 | B1 | 5/2001 | Morimoto et al. | |
| 6,263,641 | B1 | 7/2001 | Odell et al. | |
| 2005/0177100 | A1 | 8/2005 | Harper et al. | |
| 2007/0060875 | A1 | 3/2007 | Bassarab et al. | |
| 2009/0018496 | A1 * | 1/2009 | Harper et al. | 604/89 |
| 2011/0094189 | A1 | 4/2011 | Bottger et al. | |

FOREIGN PATENT DOCUMENTS

| | | | |
|---|---|---|---|
| DE | 102005038458 | A1 | 2/2007 |
| EP | 0440846 | A | 8/1991 |
| EP | 0882441 | A2 | 12/1998 |
| JP | 08-224305 | | 9/1996 |
| JP | 2002-505921 | | 2/2002 |
| JP | 2005-521478 | | 7/2005 |
| JP | 2009-504293 | | 2/2009 |
| WO | 99/45985 | A1 | 9/1999 |
| WO | 03/082369 | A2 | 10/2003 |
| WO | 2005/039669 | A2 | 5/2005 |
| WO | 2009/153018 | A1 | 12/2009 |

OTHER PUBLICATIONS

International Search Report and Written Opinion of the ISA/ ISA/, Rijswijk, NL, mailed Sep. 15, 2009.

International Search Report for PCT/EP2009/004313, Rijswijk, NL, mailed Oct. 1, 2009.

English Translation of International Preliminary Report on Patentability for PCT/EP2009/004313, incorporating the English Translation of the Written Opinion of the ISA.

English Translation of International Preliminary Report on Patentability for PCT/EP2009/004308, incorporating the English Translation of the Written Opinion of the ISA.

* cited by examiner

METHOD FOR FILLING DUAL-CHAMBER SYSTEMS IN PRE-STERILIZABLE CARRIER SYSTEMS AND PRE-STERILIZABLE CARRIER SYSTEM

CROSS-REFERENCE TO RELATED APPLICATIONS

This application is a 371 U.S. National Stage of International Application No. PCT/EP2009/004308, filed Jun. 16, 2009. This application claims priority to German Patent Application No. 10 2008 030 267.8, filed Jun. 19, 2008. The disclosures of the above applications are expressly incorporated herein by reference.

FIELD

The invention relates to a method for filling dual-chamber systems in pre-sterilizable carrier systems and to a pre-sterilizable carrier system.

BACKGROUND

Pre-sterilizable carrier systems and methods for filling the same are known. A known carrier system comprises usually washed siliconized and sterilized syringes which are placed in a magazine after the washing and siliconizing step. The magazine—also called nest—is subsequently inserted into a container which is then sealed with a closing element, preferably a gas-permeable membrane film, and sterilized via suitable sterilization methods. Here, an ethylene oxide gassing is frequently used. Because the closing element is gas-permeable, the sterilization gas can penetrate into the interior of the container and can also sterilize the content of the container, thus the washed and siliconized syringes as well as the magazine comprising the latter. After the sterilization step, the container does not need to be opened again and can be delivered in the present form directly to a customer or can be transferred to a filling line. The gas-permeable closing element has in fact a filter effect in such a manner that it is permeable for a sterilization gas, but closes the container in a tight and sterile manner with respect to germs, viruses and bacteria. As long as the container remains closed, the sterility of its content is therefore ensured. At the customer who typically operates a filling system for filling the syringes or other hollow bodies having a pharmaceutical content comprised by the container, the container is opened, the hollow bodies are filled and closed, whereupon also the container can be closed again and can be transported to the end customer. Of course, the filled and closed hollow bodies can also be removed from the container and can be delivered to the end customer in different packaging units. It is essential in the mentioned pre-sterilized carrier systems and the methods for filling the same that a standardized packaging form is used which can be used in connection with standardized filling lines. Thus, the hollow bodies to be filled do not need to be removed from the container prior to the filling, whereby a complicated work step is eliminated. Furthermore, it is advantageous that the hollow bodies can be sterilized together in already packaged form, whereupon an immediate delivery or further processing can take place without the need of complicated intermediate steps such as packing into a new pre-sterilized further packaging unit or repacking. On the part of a producing pharmaceutical company which performs the filling, a clean room or the work step for preparing the hollow bodies can be eliminated because the latter are delivered ready for filling.

The fabrication and/or preparation of the hollow bodies can also take place as in-line process with the filling if a hot-air tunnel is provided between the sterilization device and the clean room in which the filling takes place.

However, the known pre-sterilizable carrier systems and the methods for filling the same are designed only for single-chamber systems, thus single-chamber syringes, single chamber carpules or phials. In order to fill dual-chamber systems such as dual-chamber syringes or carpules, complex methods and carrier devices are still necessary.

SUMMARY

It is therefore the object of the invention to provide a method for filling at least one dual-chamber system in a pre-sterilizable carrier system.

Said method is characterized by the following steps: Provided is at least one washed, siliconized and sterilized dual-chamber system which is arranged in a magazine, the dual-chamber system comprising respective separating elements separating the two chambers from each other, the magazine accommodating the at least one dual-chamber system, preferably a number of such systems, wherein the magazine is arranged in a container sealed with a closing element. The sealed container is introduced into a clean room. There, the container is opened and a first chamber of the at least one dual-chamber system is filled. The first chamber is closed and a second chamber of the at least one dual-chamber system is filled. The second chamber is also closed and the at least one filled dual-chamber system is removed from the clean room. By using standardized pre-sterilizable carrier systems, a producing pharmaceutical company is relieved of the complex preparation of the hollow bodies, and the use of standardized filling lines is possible.

Said method is characterized by the following steps: Provided is at least one washed, siliconized and sterilized dual-chamber system which has a separating element separating the two chambers from each other. A magazine accommodates the at least one dual-chamber system, preferably a number of such systems, wherein the magazine is arranged in a container which is sealed with a closing element. The container is introduced into a clean room. The container is opened and the first chamber of the at least one dual-chamber system is filled. The container is closed with a gas-permeable closing element. A method step follows in which the material contained in the first chamber of the at least one dual-chamber system is lyophilized. Here, the solvent vapor sublimates through the gas-permeable closing element of the container. After the lyophilization, the container is opened and the first chamber of the at least one dual-chamber system is closed. A second chamber of the at least one dual-chamber system is filled and closed. The at least one filled dual-chamber system is removed from the clean room.

Also preferred is a method which is characterized in that the magazine which accommodates the at least one dual-chamber system comprises plastic and preferably consists of plastic. Hereby, the magazine is very light and thus easy to handle.

It can also be configured as product for a one-time use so that it can be disposed of after its use. Thus, the heavy metal magazine which are typical for the known carrier systems and which, on the one hand, are difficult to handle and, on the other, are difficult to autoclave to maintain them sterile, are eliminated. In contrast, in case of the carrier systems according to the invention, with each new delivery, a new plastic magazine is supplied which is allocated to precisely one dual-chamber system or a batch of dual-chamber systems and is disposed of after its use. Apart from the elimination of complex work steps, this results in that with respect to its sterility, an easily reproducible handling of dual-chamber systems is possible.

Also preferred is a method in which the container comprises plastic and preferably consists of plastic. Here too is preferably addressed that the container is used once and is disposed of after its use. To each batch of dual-chamber systems, one container is unambiguously allocated so that here too, the sterility of the batches is ensured with very high reproducibility.

Also preferred is a method which is characterized in that the closing element for the container is gas-permeable. This addresses, on the one hand, the closing element with which the container is delivered to the filling station. This closing element is preferably gas-permeable so that the container can be pre-sterilized in the already closed state at the manufacturer. The closing element is indeed configured to be permeable for sterilization gases but not for germs, viruses or bacteria. On the other hand, the closing element is addressed with which the container is closed before a possible lyophilization step is carried out. This closing element is preferably gas-permeable so that the solvent vapor released during the lyophilization can sublimate through the closing element and thus can leave the space enclosed by the container. It is preferred that both closing elements are configured as gas-permeable membrane films.

Preferred is also a method in which the container, after filling the first chamber of the at least one dual chamber system and closing it with a gas-permeable closing element, is first removed from the clean room and then introduced into a device for lyophilizing arranged outside of the clean room. There, the lyophilization takes place, after the completion of which the container is removed from the device and is introduced again into a clean room. If this step is added to the method, it is possible to completely separate the aseptic filling of the pharmaceutical content from the lyophilization, wherein the same does no longer need to be carried out in an aseptic manner. This is possible because the container is provided with a gas-permeable closing element which allows the sublimated solvent vapor during the lyophilization process to pass from the interior of the container to the outside, but prevents germs, viruses and bacteria from penetrating into the container. The interior of the container thus remains aseptic even if the environment in the lyophilizer is not sterile. In this manner, complex cleaning and disinfection steps for the lyophilizer can be eliminated and the latter does not need to be arranged within the clean room.

Also, in this connection, a method is preferred which is characterized in that the lyophilization device itself is not sterile and/or aseptic. As mentioned, this is possible by closing the container with a gas-permeable closing element which, however, is not permeable for viruses, bacteria and germs.

Further advantageous configurations with respect to the claimed method arise from the sub-claims.

It is also the object of the invention to provide a pre-sterilizable carrier system for at least one dual-chamber system.

The carrier system comprises at least one washed, siliconized and sterilized dualchamber system which has a separating element separating the two chambers from each other. Furthermore, the presterilizable carrier system comprises a magazine which serves for accommodating a dual-chamber system. It also comprises a container. The magazine which accommodates the at least one dual-chamber system can be arranged in the container, wherein the latter can be sealed with a closing element. In this manner, a closed container is created in which a magazine is arranged which comprises at least one washed, siliconized and sterilized dual-chamber system. It is particularly preferred if the entire container is sterilized in its interior. Due to the sealing, such pre-sterilized carrier systems equipped with dual-chamber systems can be produced ahead and stored, wherein the content remains sterile.

Also preferred is a pre-sterilizable carrier system, wherein the magazine comprises plastic and preferably consists of plastic. In this case, the magazine is particularly light and, moreover, is disposable after the use of the pre-sterilizable carrier system so that complex cleaning and autoclaving steps are eliminated. Also, each batch of dual-chamber systems is allocated to precisely one magazine so that a highly reproducible handling with respect to the sterility is possible.

Also preferred is a pre-sterilizable carrier system which is characterized in that the container comprises plastic and preferably consists of plastic. Also in this case, the container is provided for a one-time use so that each batch of dual-chamber systems is allocated to precisely one container. This too increases the reproducibility of the handling with respect to its sterility.

Furthermore, a pre-sterilizable carrier system is preferred in which the closing element for the container is gas-permeable. In this case, the container already equipped with the magazine and the at least one dual-chamber system can be closed at the manufacturer and can subsequently be sterilized in that the gas intended for the sterilization penetrates through the gas-permeable closing element into the interior of the container. After the sterilization it is not necessary anymore to open the container and the same can be transported immediately, for example, to a filling line. Due to the fact that the container is already finally closed, a subsequent opening or closing does not result in that germ-containing material penetrates from outside into the interior of the container. Here, the term gas-permeable addresses that the closing element allows gases and vapors to pass through, but prevents germs, viruses or bacteria from penetrating into the interior of the container.

DRAWINGS

The invention is illustrated in more detail hereinafter by means of the drawings. In the figures.

DETAILED DESCRIPTION

Figure 1:
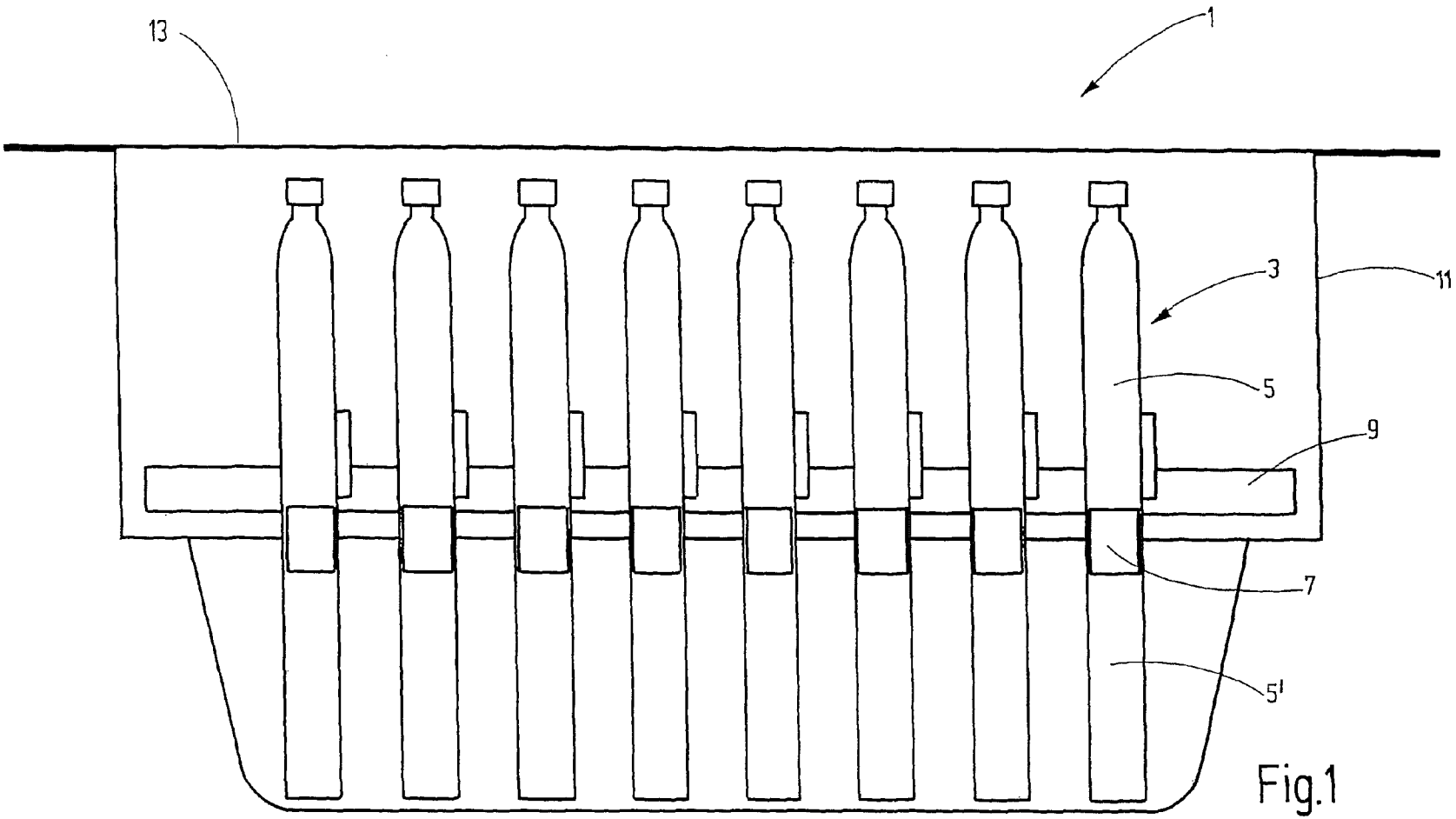
FIG. 1 shows a schematic view of a pre-sterilizable carrier system.

FIG. 1 shows schematically an exemplary embodiment of a pre-sterilized carrier system. The pre-sterilizable carrier system 1 comprises at least one washed, siliconized and sterilized dual-chamber system 3 with two chambers 5, 5' which are separated from each other by a separating element 7. The dual-chamber systems 3 are accommodated by a magazine 9 which in turn can be arranged in a container 11. The latter is sealed with a closing element 13.

The container 11 can comprise plastic and preferably consists of plastic. The magazine 9 too can comprise plastic and preferably consists of plastic. In this manner, both elements can be provided for a one-time use so that to each batch of dual-chamber systems 3, one magazine 9 and one container 11 are allocated.

The closing element 13 for the container 11 is preferably configured in a gas-permeable manner so that the fully loaded and sealed container 11 can be sterilized in the closed state by introducing the container into an atmosphere which comprises a gas intended for sterilization or a vapor intended for sterilization. The gas or the vapor can penetrate through the closing element 13 into the interior of the container 11 and thus can sterilize in particular the interior of the container 11 and the dual-chamber systems 3 and the magazine 9 contained therein.

The different methods are now illustrated in more detail by means of the FIGS. 2 to 5.

First, the pre-sterilizable carrier system 1 is provided and introduced into a clean room. Then, the closing element 13 is removed so that the dual-chamber systems 3 are accessible.

Figure 2:
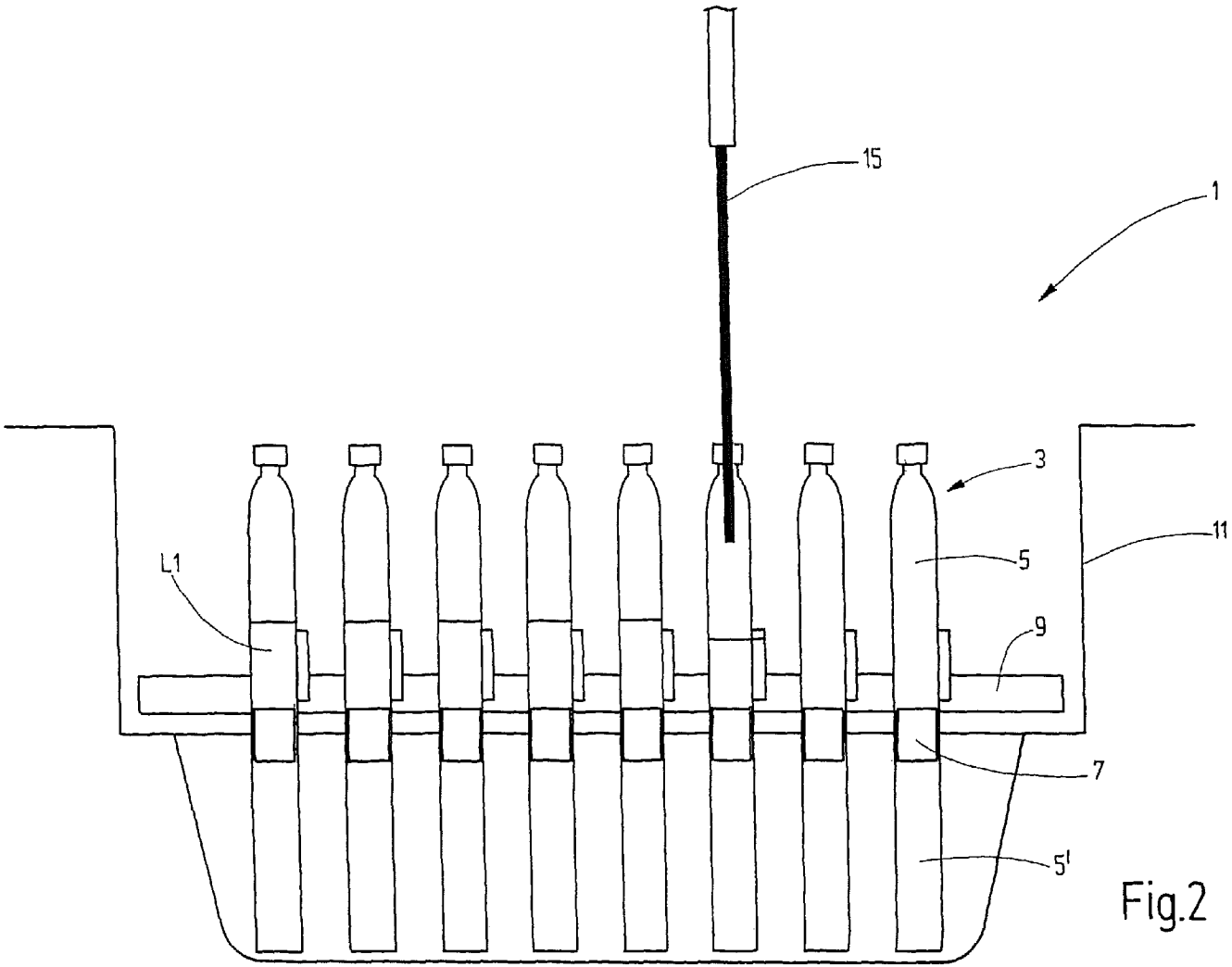
FIG. 2 shows a schematic illustration of the step of filling a first chamber of the dual-chamber systems with a method according to the invention.

FIG. 2 shows the step of filling a first chamber 5 of the dual-chamber systems 3. Identical and functionally identical elements are indicated with identical reference numbers so that in this respect, reference is made to the preceding description. A dispensing device 15 is provided through which a first solution L1 of an active and/or auxiliary substance can be introduced into a first chamber 5 of the dual-chamber systems 3.

Figure 3:
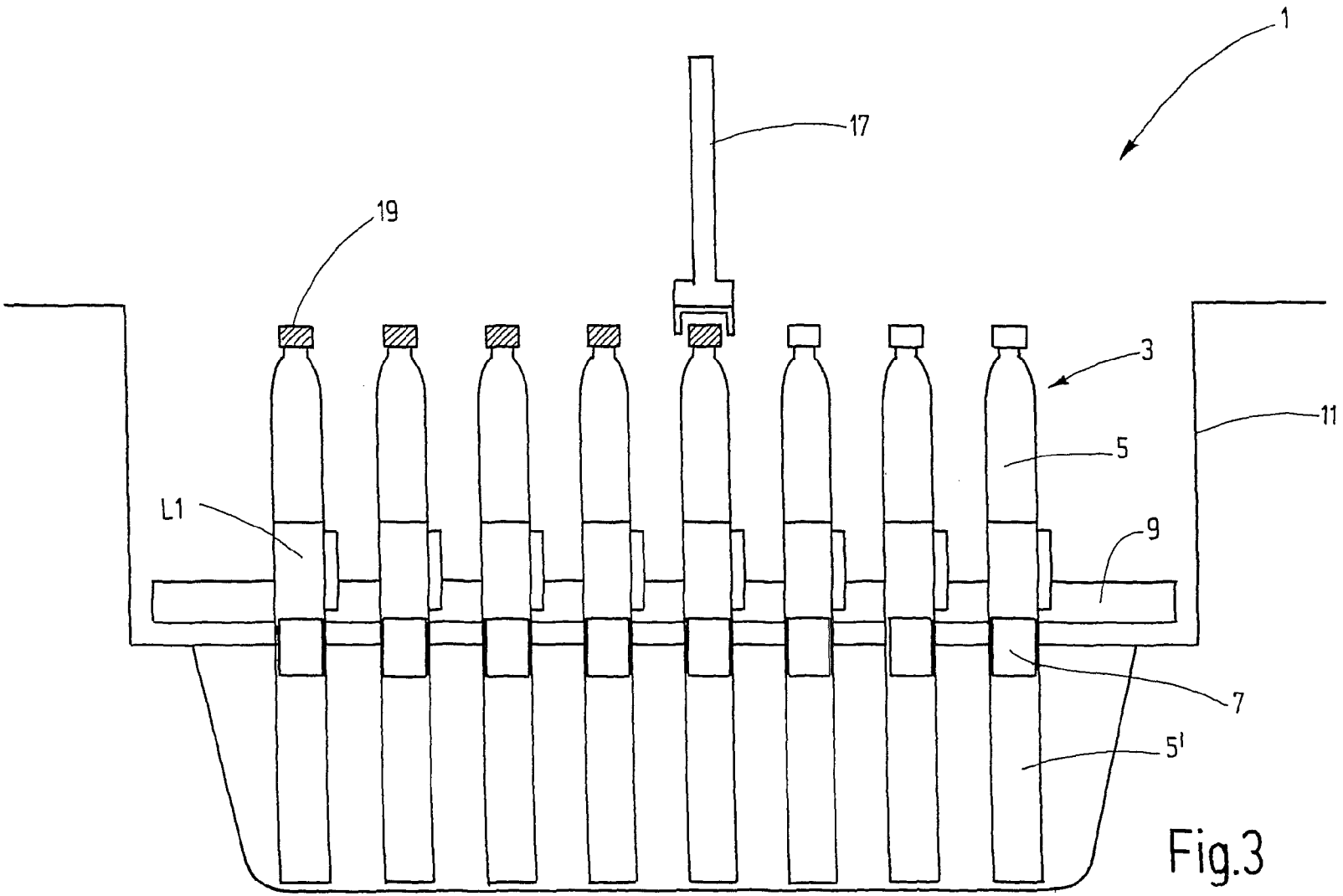
FIG. 3 shows a schematic view of the closing process of the first chamber of the dual-chamber systems with the method.

After filling the first chamber 5 of the dual-chamber systems 3, the first chamber can be closed as shown in FIG. 3. Identical and functionally identical elements are indicated with identical reference numbers so that in this respect, reference is made to the preceding description. A first closing device 17 is provided by means of which the first chamber 5 of the dual-chamber systems 3 can be closed in each case with one closure 19. The closure 19 can be a flanged cap, a tamper-proof closure, a closure with attachable needle or a closure with attached needle. In principle, other types of closures can also be used; it is essential, however, that the first chamber 5 of the dual-chamber system 3 is tightly sealed by a closure 19.

Instead of closing the first chamber 5 of the dual-chamber systems 3 directly after filling it is also possible to integrate a lyophilization step for the active substance and/or auxiliary substance contained in the solution L1. For this purpose, the container 11 is closed after filling the first chamber 5 of the dual-chamber systems 3 with a gas-permeable closing element, preferably a gas-permeable membrane film. The container 11 sealed in this manner can be introduced into a lyophilization device where the solution contained in the first chamber 5 sublimates through the gas-permeable closing element so that the active substance and/or auxiliary substance present in the dual-chamber systems 3 is lyophilized. Since the container 11 is hygienically sealed by the gas-permeable closing element 13, it is possible to provide the lyophilization device outside of the clean room. Thus, the container 11 can be removed from the clean room and can be introduced into an external lyophilization device. The latter does not have to be sterile and/or aseptic because no germs, viruses or bacteria can pass through the closing element 13 and get into the interior of the container 11. In this manner, in particular the dual-chamber systems 3 remain sterile or aseptic even if the lyophilization is carried out in a non-sterile and/or non-aseptic environment. After lyophilization, the container 11 can be introduced again into a clean room in which the further method steps take place.

Of course, it is also possible to arrange the lyophilization device in the clean room itself so that removing and re-introducing the container 11 is eliminated. It is obvious that here also the lyophilization device itself has to be sterile and/or aseptic.

During lyophilization, the dual-chamber systems 3 are embedded in the container 11 and are reliably protected against interfering radiation or other disturbing influences.

If such a lyophilization step is integrated between the filling of the first chamber 5 of the dual-chamber systems 3 and the closing of said first chamber, it is obvious that the container 11—if necessary, after re-introducing into a clean room—has to be opened again so that the dual-chamber systems 3 are accessible. After closing the first chamber 5 of the dual-chamber systems, a second chamber 5' is filled. This is possible in a particularly simple manner by turning the magazine 9 over. In this case it is provided that the magazine 9 encompasses the dual-chamber systems 3 in such a manner that the latter are securely retained in the magazine 9, independent of the orientation of the same. In this manner it is ensured that the dual-chamber systems 3 do not slip out of the magazine, not even when turning it over. After turning the magazine 9 over, the same is preferably introduced again into the container 11, wherein now a second chamber 5' of the dual-chamber systems 3 is accessible through the opening of the container 11.

Figure 4:
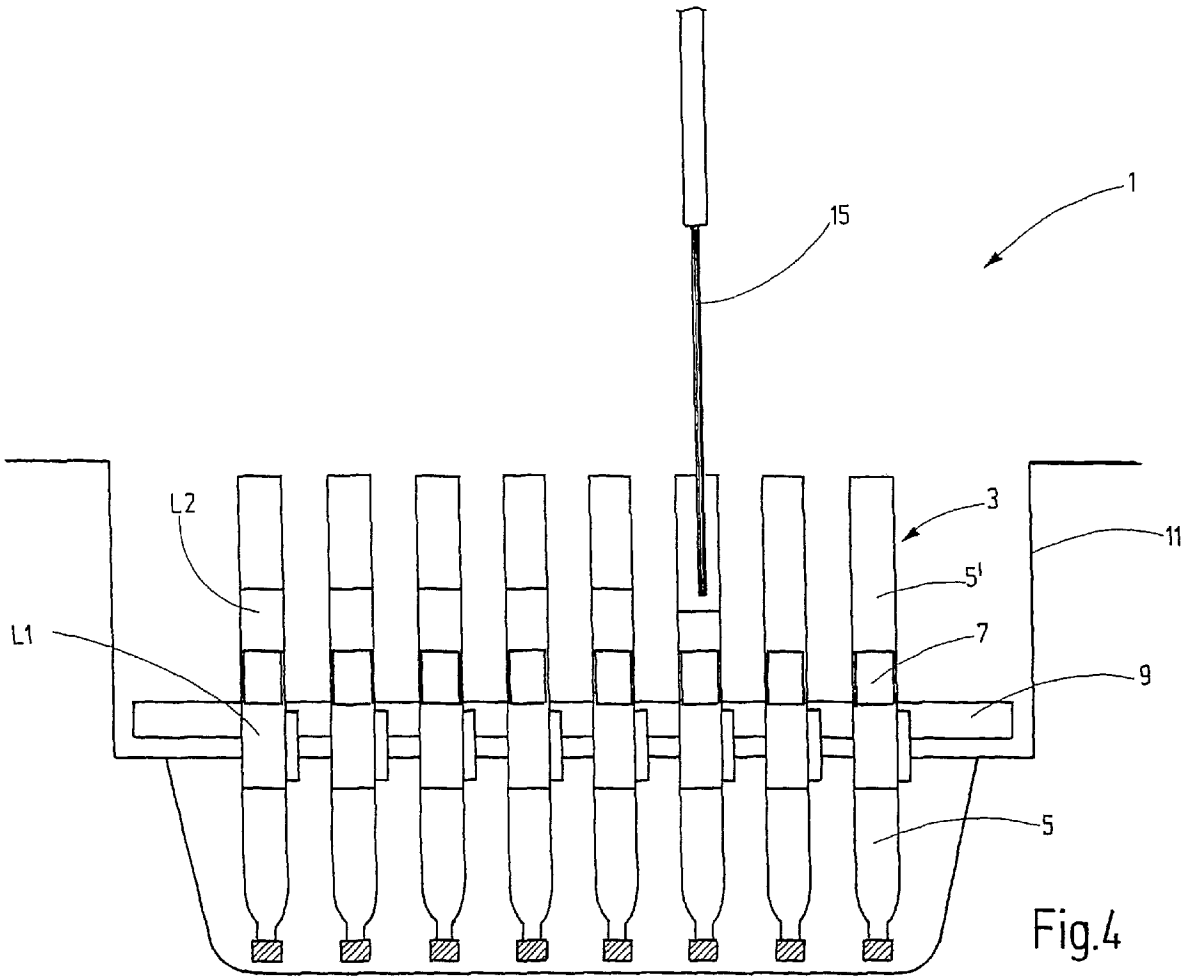
FIG. 4 shows a schematic illustration of the filling process of a second chamber of the dual-chamber systems with the method.

FIG. 4 shows schematically the filling of the second chamber 5 of the at least one dual-chamber system 3. Identical and functionally identical elements are indicated with identical reference numbers so that in this respect, reference is made to the preceding description. Here too, a dispensing device 15 is provided through which a second medium L2 can be introduced into the second chamber 5' of the dual-chamber systems 3. The second medium L2 can involve the solution of a further active substance and/or auxiliary substance; however, it can also involve a—preferably pure—solvent or solvent mixture.

After filling the second chamber 5' of the dual-chamber systems 3, said chamber can also be closed.

Figure 5:
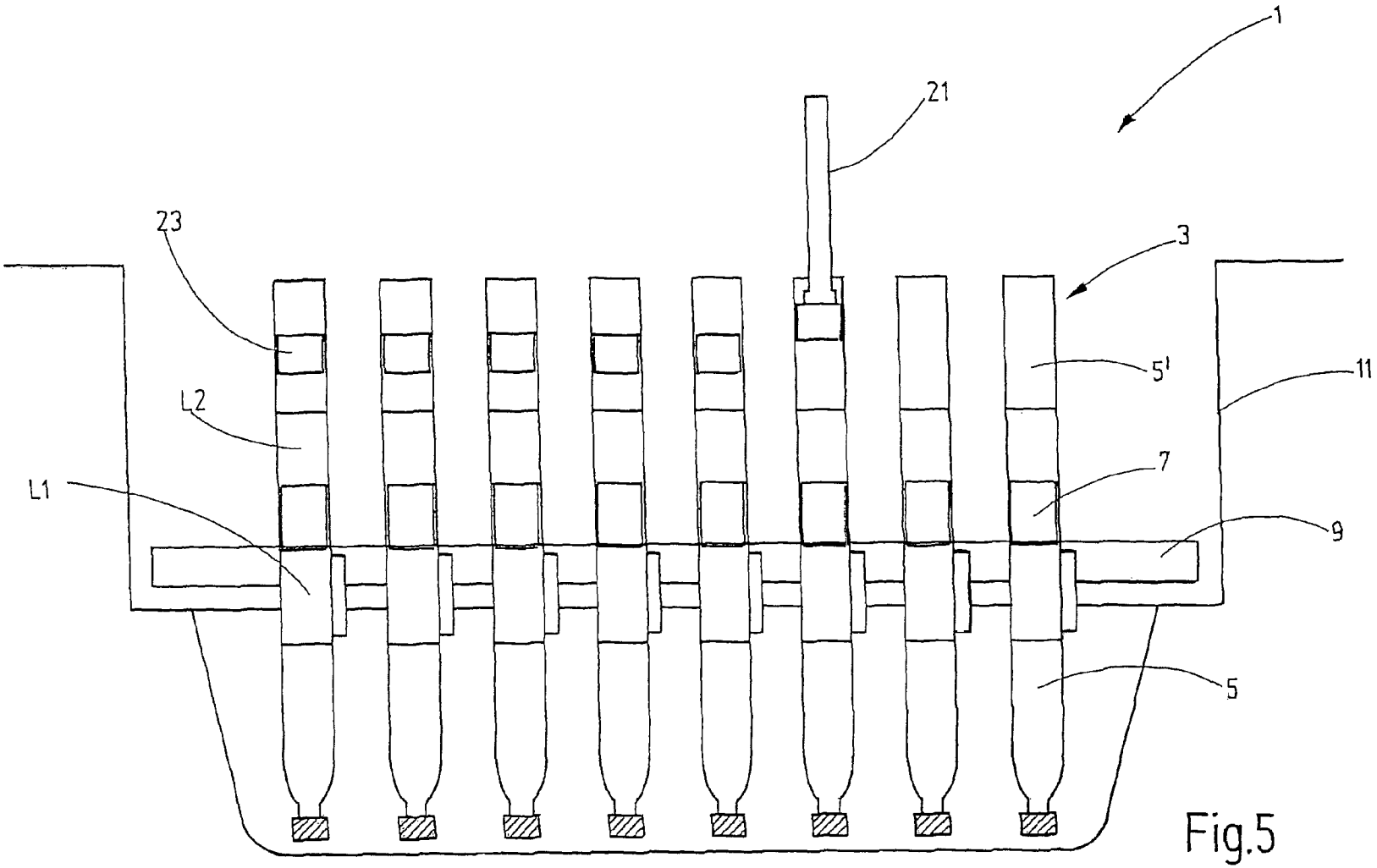
FIG. 5 shows the closing process of the second chamber of the dual-chamber system with the method.

FIG. 5 shows schematically the step of closing the second chamber 5' of the dual-chamber systems 3. Identical and functionally identical elements are indicated with identical reference numbers so that in this respect, reference is made to the preceding description. The second chamber 5' is closed by means of a second closing device 21 with a closing element which is exemplary configured here as plug 23. The latter is preferably displaceable in the dual-chamber system 3 so that pressure forces can be transmitted via the plug into the second chamber 5' and finally into the separating element 7, wherein the pressure forces result in an activation of the dual-chamber system 3. It is preferred that the plug 23 is configured as threaded plug. In this manner, it can act as plunger element, wherein a non-illustrated plunger rod can be engaged by means of an external thread with the internal thread of the threaded plug 23. Thus, pressure forces can be transmitted in a very simple manner into the second chamber 5' and therefore indirectly into the separating element 7, wherein the pressure forces result in an activation of the dual-chamber systems 3.

After closing the second chamber 5', the container 11 can be closed again and can be removed from the clean room. It is also possible to omit the closing of the container 11 and to selectively remove the container in its open state from the clean room or to remove only the magazine 9 or even the individual dual-chamber systems 3 from the clean room. Since both chambers 5, 5' of the dual-chamber systems 3 are tightly sealed, it is not required to keep the dual-chamber systems 3 any longer in a sterile and/or aseptic environment.

Overall, it is apparent that the production method according to the invention and the pre-sterilizable carrier system according to the invention are advantageous over the known methods and devices for filling dual-chamber systems. According to the invention it is possible for a producing pharmaceutical company to use a standardized packing directly on standardized filling lines. Here, it is also possible to fill products intended for lyophilization on plants which are configured for pre-sterilizable systems. In known methods, specifically for filling dual-chamber systems in connection with materials intended for lyophilization, heavy and expensive metallic magazines are used which are re-used and therefore have to be autoclaved in a costly manner. In the present case, instead of such magazines, a standardized packing form is used during the entire filling process, wherein the packing form is used only once and is disposed of afterwards. Since the carrier system according to the invention is gas-permeable but can be sealed to be impenetrable for germs, viruses or bacteria, it is possible to arrange the filling area and the lyophilization area decentralized with respect to each other which, moreover, allows to carry out the lyophilization in a non-sterile environment. The content of the carrier system according to the invention thus remains sterile at any time. Furthermore, in known methods it is necessary to close each individual chamber 5, 5' of the dual-chamber systems 3 prior to the lyophilization step with a so-called lyo closure, whereby the selection of the closure of the first chamber is limited. In contrast, in the present method it is possible to select any closure system. This is achieved by the fact that the container 11 itself is closed by a gas-permeable closing element 13 so that an individual closing of the first chamber of the dual-chamber systems 3 is not necessary for the lyophilization step. Since during the semi-automatic, automatic or manual loading and unloading of the lyophilizer, hygienically closed containers are handled, there is again a significantly lower contamination risk as this is the case with known methods.

The invention claimed is:

1. A method for filling dual-chamber systems in pre-sterilizable carrier systems, the method comprising:

providing at least one washed and sterilized dual-chamber system in a magazine, each dual-chamber system having a separating element separating first and second chambers, the magazine accommodating at least one dual-chamber system and being arranged in a container that is sealed with a closing element;

introducing the container into a clean room;

opening the container and filling a first chamber of the at least one dual-chamber system;

closing the first chamber of the at least one dual-chamber system;

filling a second chamber of the at least one dual-chamber system;

closing the second chamber of the at least one dual-chamber system; and removing the system from the clean room.

2. The method according to claim 1, wherein the magazine is at least partially constructed of plastic.

3. The method according to claim 1, wherein the container is at least partially constructed of plastic.

4. The method according to claim 1, wherein the closing element is gas-permeable for the container.

5. The method according to claim 1, further comprising turning over the magazine after closing the first chamber and before filling the second chamber of the at least one dual-chamber system.

6. The method according to claim 1, wherein the first chamber of the at least one dual-chamber system is closed with a flanged cap, a tamper-proof closure, a closure with attachable needle or a closure with attached needle.

7. The method according to claim 1, wherein the second chamber of the at least one dual-chamber system is closed with a plug.

8. A method for filling dual chamber systems in pre-sterilizable carrier systems, the method comprising:

providing at least one washed and sterilized dual-chamber system in a magazine, each dual-chamber system having a separating element separating first and second chambers, the magazine accommodating at least one dual-chamber system and being arranged in a container that is sealed with a closing element;

introducing the container in a clean room;

opening the container and filling a first chamber of the at least one dual-chamber system;

closing the container with a gas-permeable closing element;

lyophilizing a solution contained in the first chamber of the at least one dual-chamber system;

opening the container and closing the first chamber of the at least one dual-chamber system;

filling a second chamber of the at least one dual-chamber system;

closing the second chamber of the at least one dual-chamber system; and removing the system from the clean room.

9. The method according to claim 8, wherein the magazine is at least partially constructed of plastic.

10. The method according to claim 8, wherein the container is at least partially constructed of plastic.

11. The method according to claim 8, wherein the closing element is gas-permeable for the container.

12. The method according to claim 8, wherein after filling the first chamber of the at least one dual-chamber system and closing with a gas-permeable closing element, the container is removed from the clean room and introduced in a lyophilization device in which the lyophilization takes place and which is arranged outside of the clean room, and that the container is removed from the device after the lyophilization and is re-introduced into the clean room.

13. The method according to claim 12, wherein the lyophilization device itself is not sterile and/or aseptic.

14. The method according to claim 8, further comprising turning over the magazine after closing the first chamber and before filling the second chamber of the at least one dual-chamber system.

15. The method according to claim 8, wherein the first chamber of the at least one dual-chamber system is closed with a flanged cap, a tamper-proof closure, a closure with attachable needle or a closure with attached needle.

16. The method according to claim 8, wherein the second chamber of the at least one dual-chamber system is closed with a plug.

17. The method according to claim 16, wherein the second chamber of the at least one dual-chamber system can be closed with a threaded plug.

* * * * *